US008132832B2

(12) United States Patent
Anderson

(10) Patent No.: US 8,132,832 B2
(45) Date of Patent: Mar. 13, 2012

(54) DOOR JAMB REINFORCING SYSTEM

(76) Inventor: Edward R. Anderson, McLeansville, NC (US)

( * ) Notice: Subject to any disclaimer, the term of this patent is extended or adjusted under 35 U.S.C. 154(b) by 0 days.

(21) Appl. No.: 12/126,085

(22) Filed: May 23, 2008

(65) Prior Publication Data

US 2008/0224486 A1 Sep. 18, 2008

Related U.S. Application Data

(63) Continuation-in-part of application No. 11/484,074, filed on Jul. 11, 2006, now abandoned.

(51) Int. Cl.
*E05B 15/02* (2006.01)
*E05B 15/00* (2006.01)

(52) U.S. Cl. ..... 292/340; 292/341; 292/341.18; 292/346

(58) Field of Classification Search ..... 292/340, 292/346, 341.18, 341
See application file for complete search history.

(56) References Cited

U.S. PATENT DOCUMENTS

| | | | | | |
|---|---|---|---|---|---|
| 2,726,892 | A * | 12/1955 | Zynda et al. | 292/341.14 |
| 3,007,732 | A * | 11/1961 | Schlage | 292/341.12 |
| 3,316,007 | A * | 4/1967 | Russell | 292/341.12 |
| 3,524,669 | A * | 8/1970 | Reid | 292/346 |
| 3,792,893 | A * | 2/1974 | Grotnes | 292/256.61 |
| 3,939,752 | A * | 2/1976 | Koscik | 411/548 |
| 4,045,065 | A * | 8/1977 | Johnson | 292/341.17 |
| 4,105,235 | A * | 8/1978 | Thiel | 292/341.18 |
| RE30,326 | E * | 7/1980 | van Buren, Jr. | 220/326 |
| D283,299 | S * | 4/1986 | Mazie | D8/343 |
| 5,070,650 | A * | 12/1991 | Anderson | 49/460 |
| 5,094,489 | A * | 3/1992 | Jones | 292/340 |
| D375,446 | S * | 11/1996 | Nelson | D8/343 |
| 5,640,808 | A * | 6/1997 | Simeone et al. | 49/504 |
| 6,176,527 | B1 * | 1/2001 | Bench | 292/340 |
| 6,698,807 | B1 * | 3/2004 | Wacker | 292/341.14 |
| 6,834,897 | B1 * | 12/2004 | Walker | 292/340 |
| 6,901,706 | B2 * | 6/2005 | Olberding et al. | 49/460 |
| 2006/0214437 | A1 * | 9/2006 | Farzan | 292/340 |
| 2008/0284182 | A1 * | 11/2008 | Canerdy, Jr. | 292/346 |

* cited by examiner

*Primary Examiner* — Carlos Lugo
(74) *Attorney, Agent, or Firm* — MacCord Mason PLLC

(57) ABSTRACT

A door jamb reinforcing system comprising a first reinforcing member, wherein the first reinforcing member comprises a plurality of first screw receiving openings for receiving mounting screws, a latch bolt receiving aperture, and at least one deadbolt latch bolt receiving aperture; a strike plate; and a second reinforcing member, wherein the second reinforcing member has a substantially L-shaped cross section and comprises a plurality of corresponding second screw receiving openings for receiving mounting screws, a strike plate receiving aperture, and at least one deadbolt latch bolt receiving aperture, wherein the deadbolt latch bolt receiving aperture is formed to correspond to the deadbolt latch bolt receiving aperture; wherein when the first reinforcing member and the second reinforcing member are attachable to a door frame in overlying contacting abutting relation with each other and with the door jamb with mounting screws.

5 Claims, 8 Drawing Sheets

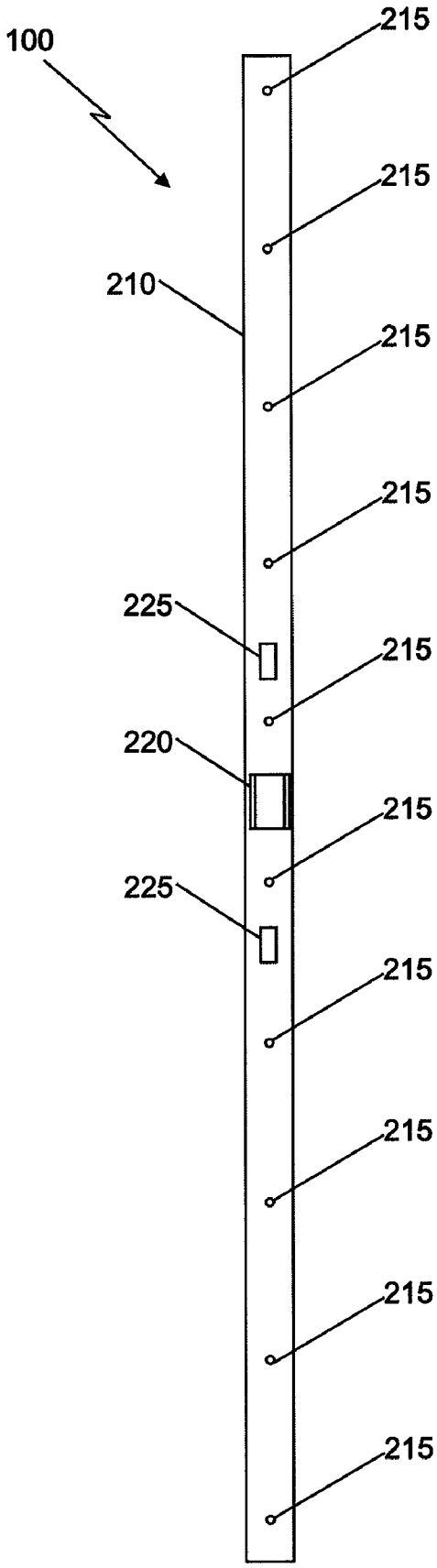
FIG. 2A
FIG. 2B
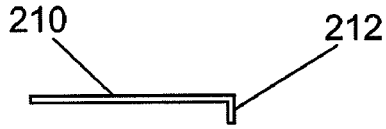
FIG. 3A
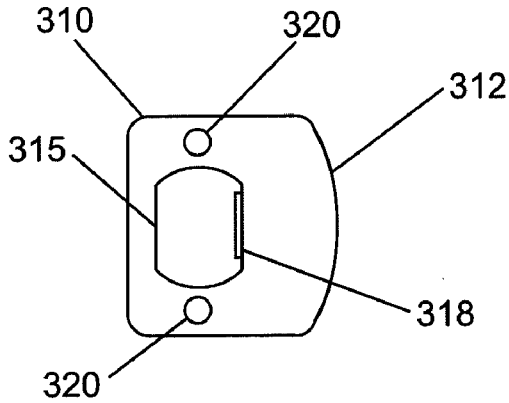
FIG. 3B
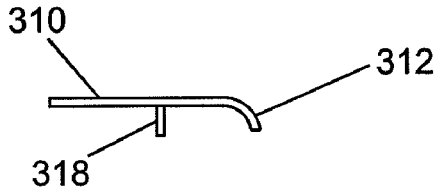

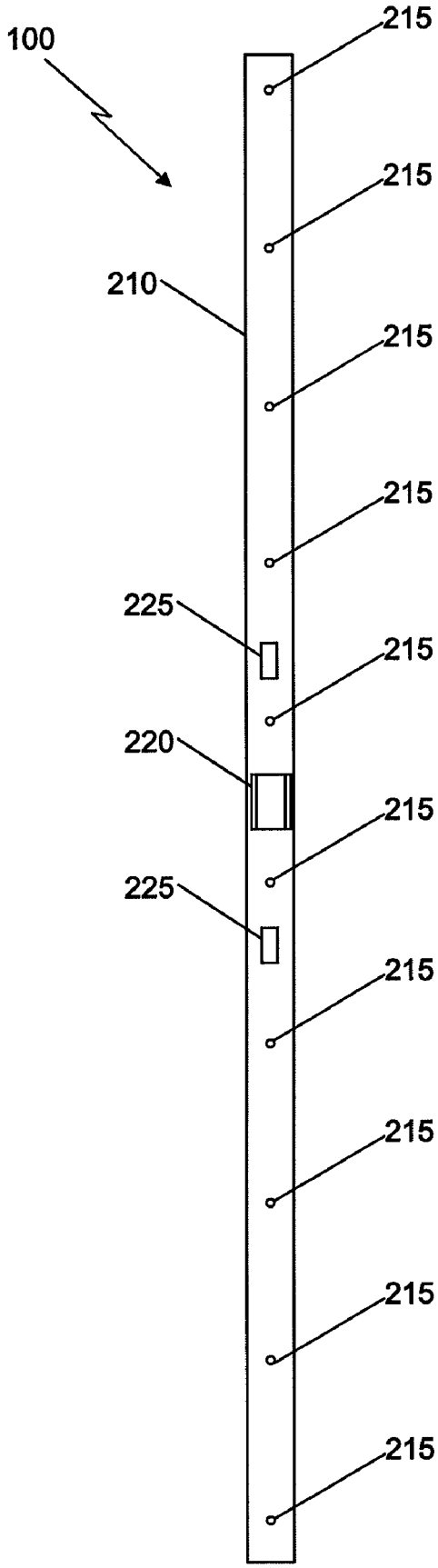
FIG. 4A
FIG. 4B
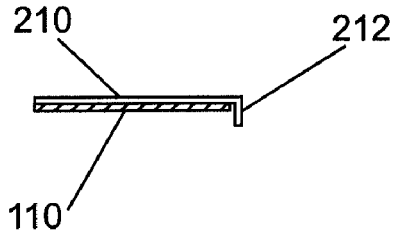

DOOR JAMB REINFORCING SYSTEM

CROSS-REFERENCE TO RELATED APPLICATIONS

This application is a continuation-in-part of pending U.S. patent application Ser. No. 11/484,074 filed on Jul. 11, 2006 and entitled, "Door Jamb Reinforcing System".

FIELD OF THE INVENTION

This invention relates generally to the field of doorway reinforcement systems. In particular, the present invention relates to a reinforcement system that is attachable to retrofit an existing door jamb without requiring the doorway to be dismantled.

BACKGROUND

Most doors used in construction today are of the "pre-hung" type. More particularly, the door and door frame are prefabricated and are sold as a unit. The entire door and door frame unit is then installed by the purchaser. A large percentage of these pre-hung doors are made entirely of wood and are installed as entry doors. While entry doors are intended to function to exclude uninvited guests when locked, they are often inadequate for that purpose.

Entry doors, particularly residential entry doors, typically include both a primary door knob lock assembly, or lockset, and a supplemental deadbolt. Typically, when an entry door is closed, the lockset latch bolt protrudes from the entry door into an appropriate opening in a strike plate. The strike plate is typically affixed to the door jamb of the door casing by two screws.

A deadbolt typically acts as a supplemental lock to ensure that the entry door remains closed. When the deadbolt is activated, the deadbolt latch bolt protrudes from the entry door into an appropriate opening in another strike plate attached to the door frame.

Unfortunately, even when lock sets and deadbolts are used, it can be relatively easy for an intruder, such as a burglar, to gain entry to the dwelling or business by forcefully kicking the door in the general vicinity of the door lock latch bolt and/or the deadbolt latch bolt, thereby breaking the door jamb where the strike plates are located and allowing the door to be opened.

SUMMARY OF THE INVENTION

Therefore, the present invention relates generally to a reinforcement system that is attachable to retrofit an existing door jamb without requiring the doorway to be dismantled, cut, or mortised.

In various, non-limiting embodiments, the door jamb reinforcing system comprises a first reinforcing member and a second reinforcing member that are adapted to be mounted flush with an inner bolt receiving face of the door jamb.

In various other exemplary embodiments, the first reinforcing member comprises a flat elongate metal plate having appropriate apertures so as to be able to receive a lockset latch bolt and a deadbolt latch bolt.

In various, non-limiting embodiments, the substantially L-shaped cross sectional profile of the second reinforcing member allows the second reinforcing member to lie in contacting abutting relation with the outer face of the door jamb. In various, non-limiting embodiments, the substantially L-shaped cross sectional profile of the second reinforcing member allows the second reinforcing member to be slidably inserted beneath the decorative molding of the door jamb.

Thus, the first reinforcing member and the second reinforcing member may be coupled to a door jamb in overlying contacting relation with each other and with the door jamb to strengthen the door jamb.

Accordingly, this invention provides a system for reinforcing door jambs.

This invention separately provides a door jamb reinforcing system of improved design.

This invention separately provides a door jamb reinforcing system, which is capable of being installed without having to remove the decorative molding from around the door frame.

This invention separately provides a door jamb reinforcing system, which is capable of being installed without damaging the decorative molding surrounding the door jamb.

This invention separately provides a door jamb reinforcing system, which can easily be retrofitted to existing door jambs.

This invention separately provides a door jamb reinforcing system, which can be used to repair damaged door jambs.

This invention separately provides a door jamb reinforcing system, which is universally adaptable to practically any door jamb.

This invention separately provides a door jamb reinforcing system, which can be adapted to any door jamb using light duty tools.

This invention separately provides a door jamb reinforcing system, which can be installed without cutting or mortising the door jamb.

These and other features and advantages of this invention are described in or are apparent from the following detailed description of the exemplary embodiments.

BRIEF DESCRIPTION OF THE DRAWINGS

The exemplary embodiments of this invention will be described in detail with reference to the following figures, wherein like reference numerals refer to like parts throughout the several views.

FIGS. 2A and 2B show a front and side view of an embodiment of a second reinforcing member of the door jamb reinforcing system according to the invention.

FIGS. 3A and 3B show a front and side view of an embodiment of a strike plate to be used with the door jamb reinforcing system according to the invention.

FIGS. 4A and 4B show a front and side view of an embodiment of a door jamb reinforcing system according to the invention.

DETAILED DESCRIPTION OF THE EMBODIMENTS

Unless defined otherwise, all technical and scientific terms used herein have the same meaning as commonly understood by one of ordinary skill in the art to which this invention belongs. However, it should be appreciated that exemplary, non-limiting methods and materials are described herein and any methods and/or materials similar or equivalent to those described herein can be used in practicing the present invention.

It should also be appreciated that the term "door jamb reinforcing system" is used for basic explanation and understanding of the operation of the systems, methods, and apparatuses of this invention. Therefore, the term "door jamb reinforcing system" is not to be construed as limiting the systems, methods, and apparatuses of this invention.

Figure 1A:
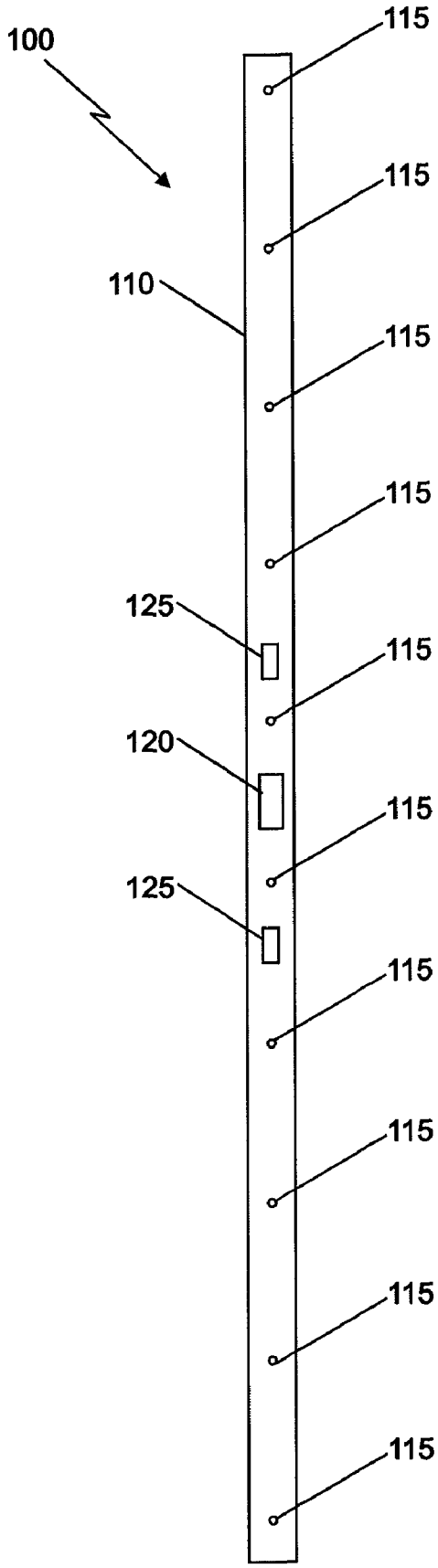
FIGS. 1A and 1B show a front and side view of an embodiment of a first reinforcing member of the door jamb reinforcing system according to the invention.
Figure 1B:
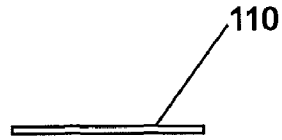

FIGS. 1A and 1B show a front and a top view, respectively, of an embodiment of a first reinforcing member 110 of the door jamb reinforcing system 100, while FIGS. 2A and 2B show a front and a top view, respectively, of an embodiment of a second reinforcing member 210 of the door jamb reinforcing system 100.

As shown in FIGS. 1A and 1B, the first reinforcing member 110 is a substantially flat, rigid portion of elongate metal plate. Alternate materials of construction of the first reinforcing member 110 may include one or more of the following: steel, stainless steel, aluminum, titanium, and/or other metals, as well as various alloys and composites thereof. Thus, it should be understood that the material or materials used to form the first reinforcing member 110 is a design choice based on the desired appearance, functionality, and/or compatibility of the first reinforcing member 110.

The first reinforcing member 110 includes a plurality of spaced apart holes defining first screw receiving openings 115 for mounting screws. The first reinforcing member 110 further includes a first cut out area defining a latch bolt receiving aperture 120. The latch bolt receiving aperture 120 is formed so as to be able to receive a lockset latch bolt within the latch bolt receiving aperture 120, when the first reinforcing member 110 is installed on a door jamb.

In various exemplary embodiments, the latch bolt receiving aperture 120 is generally formed centrally to the first reinforcing member 110. In this manner, the door jamb reinforcing system 100 may be used equally as easily on a right-handed door as a left-handed door. However, it should be appreciated that the latch bolt receiving aperture 120 may be formed in any area of the first reinforcing member 110. the overall size, shape, and placement of the latch bolt receiving aperture 120 is a design choice based on the desired appearance, functionality, and/or compatibility of the door jamb reinforcing system 100 and the first reinforcing member 110.

The first reinforcing member 110 further includes at least one second cut out area defining at least one deadbolt latch bolt receiving aperture 125. The at least one deadbolt latch bolt receiving aperture 125 is formed above the latch bolt receiving aperture 120 an appropriate distance so as to be able to receive a deadbolt latch bolt within the deadbolt latch bolt receiving aperture 125, when installed on a door jamb. In various exemplary embodiments, the first reinforcing member 110 includes at least two deadbolt latch bolt receiving apertures 125. In these exemplary embodiments, the deadbolt latch bolt receiving apertures 125 are formed above and below the latch bolt receiving aperture 120 an appropriate distance so as to be able to receive a deadbolt latch bolt within the deadbolt latch bolt receiving aperture 125, whether installed on a right-handed door or a left-handed door.

However, it should be appreciated that the deadbolt latch bolt receiving aperture(s) 125 may be formed in any area of the first reinforcing member 110 where appropriate to receive a deadbolt latch bolt within at least one of the deadbolt latch bolt receiving aperture(s) 125 when installed. The overall size, shape, number, and placement of the deadbolt latch bolt receiving aperture(s) 125 is a design choice based on the desired appearance, functionality, and/or compatibility of the door jamb reinforcing system 100 and the first reinforcing member 110.

As shown in FIGS. 2A and 2B, a second reinforcing member 210 comprises an elongate metal plate having a main body portion and a lip portion 212, such that the second reinforcing member 210 has a substantially L-shaped cross section. The L-shaped cross section of the second reinforcing member 210 contributes to the overall rigidity of the second reinforcing member 210 and the door jamb reinforcing system 100.

Alternate materials of construction of the second reinforcing member 210 may include one or more of the following: steel, stainless steel, aluminum, titanium, and/or other metals, as well as various alloys and composites thereof. Thus, it should be understood that the material or materials used to form the second reinforcing member 210 are a design choice based on the desired appearance, functionality, and/or compatibility of the second reinforcing member 210.

The second reinforcing member 210 includes a plurality of spaced apart holes defining second screw receiving openings 215 for mounting screws. In various exemplary embodiments, each of the second screw receiving openings 215 corresponds to the first screw receiving openings 115 of the first reinforcing member 110. In this manner, when an appropriate mounting screw is placed in one of the second screw receiving openings 215, the mounting screw can protrude through both the second screw receiving opening 215 and its corresponding first screw receiving openings 115. It should be appreciated that each of the second screw receiving openings 215 may be countersunk in order for the mounting screws, once installed, to be substantially flush with an exposed surface of the door jamb reinforcing system 100.

The second reinforcing member 210 further includes a first cut out area defining a strike plate receiving aperture 220. The strike plate receiving aperture 220 is formed so as to be able to receive a strike plate, such as, for example, the strike plate 310 shown in FIGS. 3A and 3B.

The strike plate receiving aperture 220 is generally cut out to correspond to the location of the latch bolt receiving aperture 120. In this manner, when the first reinforcing member 110 and the second reinforcing member 210 are aligned and an appropriate strike plate 310 is mounted or installed in the strike plate receiving aperture 220, a lockset latch bolt may be received within, for example, the latch bolt receiving aperture 315 of the strike plate 310 and the latch bolt receiving aperture 120 of the first reinforcing member 110, when the door jamb reinforcing system 100 is installed on a door jamb.

It should be appreciated that the overall size, shape, and placement of the first cut out area for the strike plate receiving aperture 220 is a design choice based on the desired appearance, functionality, and/or compatibility of the door jamb reinforcing system 100 with the first reinforcing member 110 and the strike plate.

The second reinforcing member 210 further includes at least one second cut out area defining at least one deadbolt latch bolt receiving aperture 225. The deadbolt latch bolt receiving aperture 225 is generally formed to correspond to the size and location of the deadbolt latch bolt receiving aperture 125. In this matter, when the first reinforcing member 110 and the second reinforcing member 210 are aligned, a deadbolt latch bolt may be received within the deadbolt latch bolt receiving aperture 225 of the second reinforcing member 210 and the deadbolt latch bolt receiving aperture 125 of the first reinforcing member 110.

It should be appreciated that the second reinforcing member 210 may include at least two deadbolt latch bolt receiving apertures 225. In these exemplary embodiments, the deadbolt latch bolt receiving apertures 225 are formed so as to correspond to the deadbolt latch receiving apertures 125 so as to be installable on a right-handed door or a left-handed door.

FIGS. 3A and 3B show a front view and a side view, respectively, of a strike plate 310 that can be used with the door jamb reinforcing system 100 and, more particularly, to be mounted or installed within the strike plate receiving aperture 220. As shown in FIGS. 3A and 3B, the strike plate 310 includes at least some of a ramped surface 312, a cut out area defining a latch bolt receiving aperture 315, spaced apart holes defining screw openings 320, and a latch bolt adjustment tab 318. The latch bolt adjustment tab 318 can be bent or otherwise manipulated to adjust the effective size of the latch bolt receiving aperture 315 to more snugly accept a latch bolt. This is typically done following installation and is intended to reduce or eliminate any door wiggle that may result from a latch bolt that is not entirely snug within the latch bolt receiving aperture 315 of the strike plate 310.

Figure 5A:
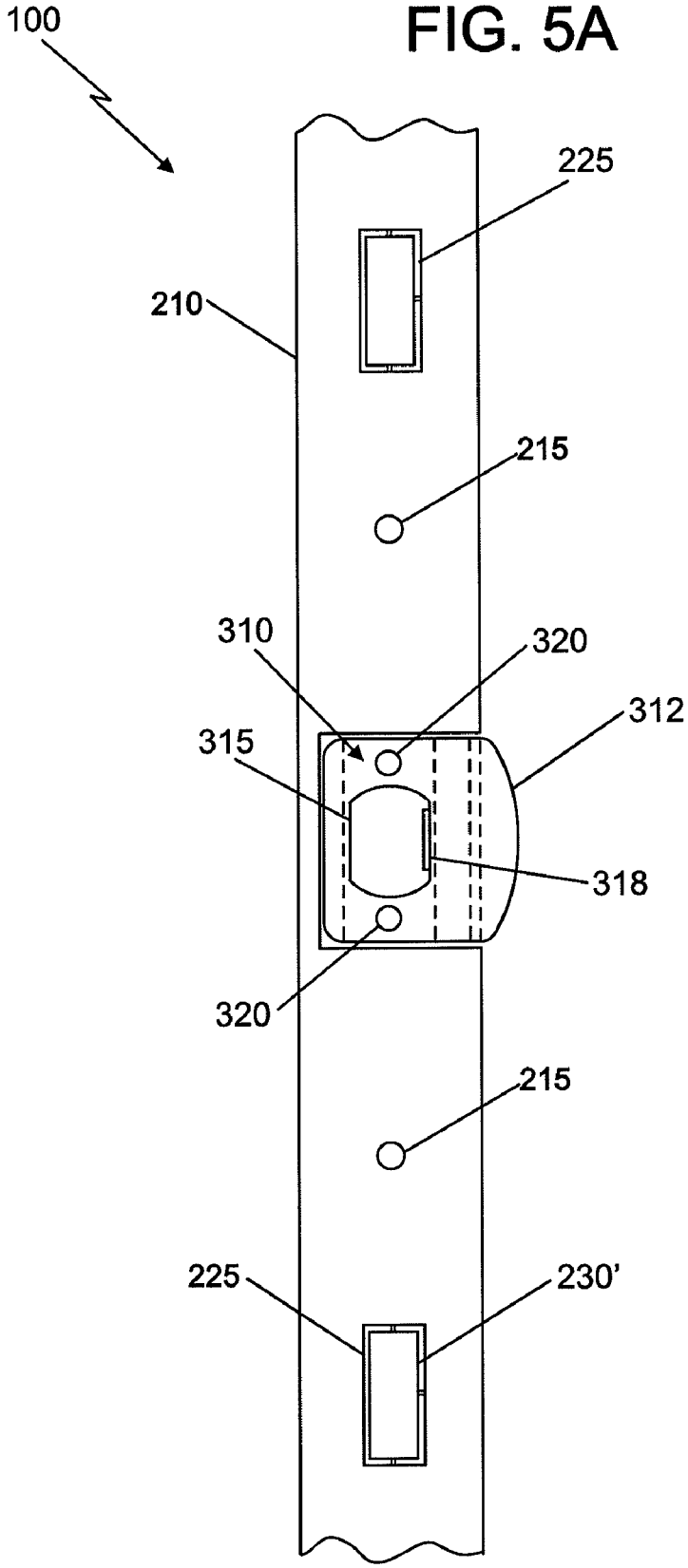
FIGS. 5A and 5B show a more detailed front and side view of a first side of an embodiment of a door jamb reinforcing system according to the invention, wherein a strike plate has been inserted in the second reinforcing member.
Figure 5B:
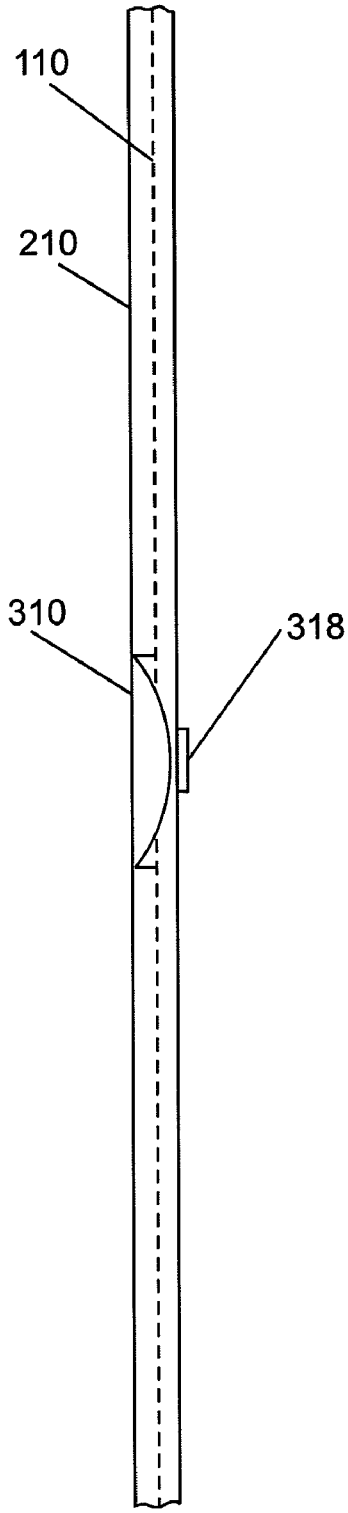

FIGS. 4A and 4B show a front view and a top view, respectively, of a first exemplary embodiment of a door jamb reinforcing system 100 according to this invention, while FIGS. 5A and 5B show a more detailed front view and a side view of the door jamb reinforcing system 100, wherein the strike plate 310 has been inserted in door jamb reinforcing system 100.

As shown in FIGS. 4A through 5B, when the first reinforcing member 110 and the second reinforcing member 210 are aligned, the corresponding first screw receiving openings 115 and second screw receiving openings 215 are aligned, the latch bolt receiving aperture 120 and the strike plate receiving aperture 220 are aligned, and the deadbolt latch bolt receiving aperture(s) 125 and deadbolt latch bolt receiving aperture(s) 225 are aligned. Furthermore, when the first reinforcing member 110 and the second reinforcing member 210 are aligned, the strike plate 310 can be positioned within the latch bolt receiving aperture 120.

In various exemplary, non-limiting embodiments, the first reinforcing member 110 and the second reinforcing member 210 are abutted together when mounting screws are placed in corresponding first screw receiving openings 115 and second screw receiving openings 215 and the mounting screws are threaded into a door jamb.

Alternatively, the first reinforcing member 110 and the second reinforcing member 210 may be permanently or releasably coupled together, as shown in FIGS. 4A through 5B. In various exemplary embodiments, the first reinforcing member 110 and the second reinforcing member 210 may be coupled together via, for example, various welds or a permanent or releasable adhesive layer between the first reinforcing member 110 and the second reinforcing member 210. In these exemplary embodiments, when the door jamb reinforcing system 100 is to be installed, the first reinforcing member 110 and the second reinforcing member 210 are already aligned.

As shown in FIG. 5A, the door jamb reinforcing system 100 may optionally be supplied with one or more optional deadbolt latch bolt receiving aperture plugs 230. If included, the deadbolt latch bolt receiving aperture plugs 230 can be left in place to fill in any of the deadbolt latch bolt receiving aperture(s) 225 that will not be utilized.

The deadbolt latch bolt receiving aperture plug(s) 230 may be held in place by, for example, a plurality of connectors 235 that are relatively easy to break. The space that a deadbolt latch bolt receiving aperture plug 230 does not fill within a deadbolt latch bolt receiving aperture 225 can be filled in, if desired, with caulk, putty (or the like) upon completion of installation of the door jamb reinforcing system 100.

Figure 6:
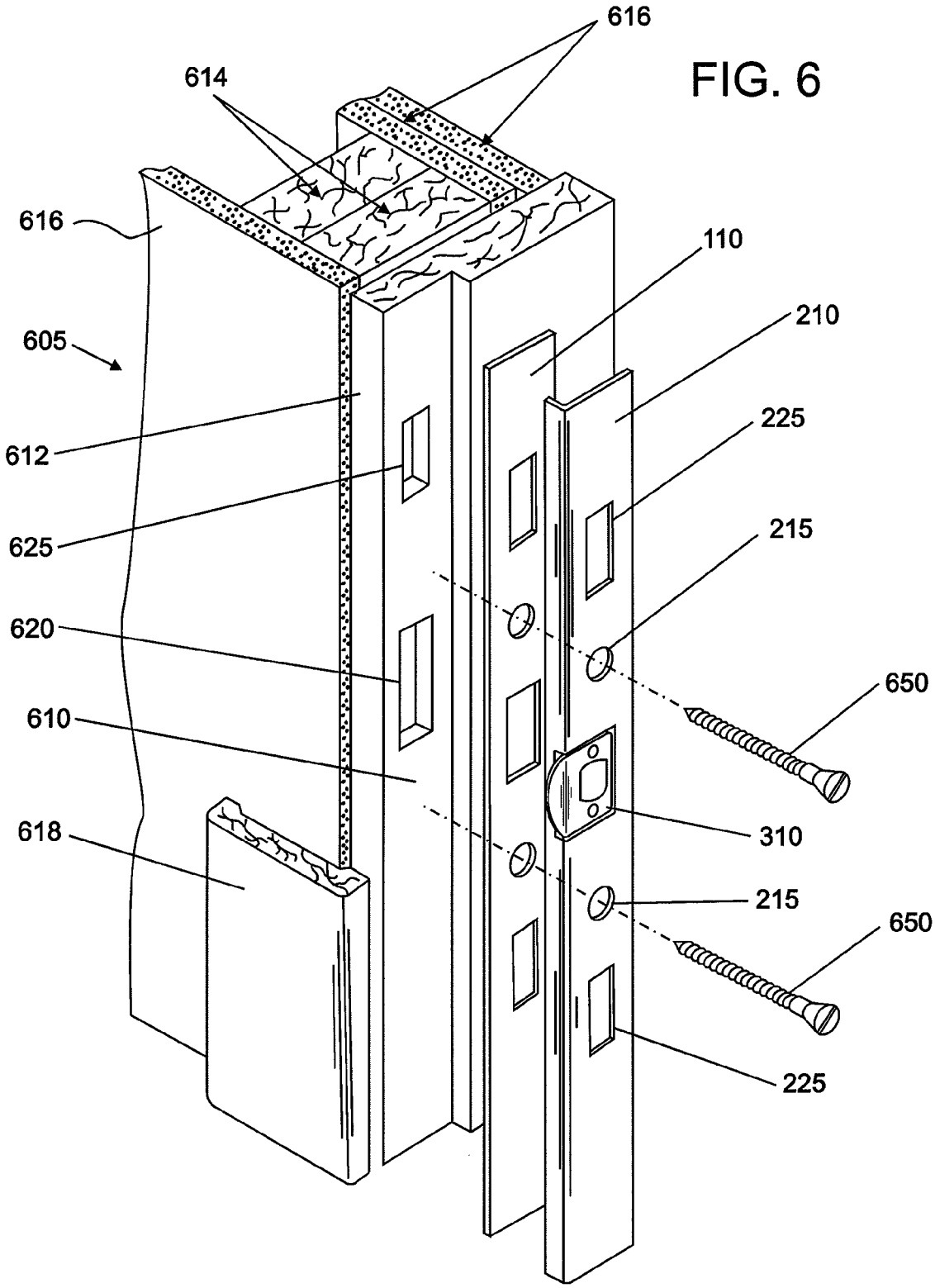
FIG. 6 shows a view of an embodiment of a door jamb reinforcing system, wherein the door jamb reinforcing system is being installed on a door jamb according to the invention.

FIG. 6 shows a view of an embodiment of a door jamb reinforcing system 100, wherein the door jamb reinforcing system 100 is being installed on a typical door jamb. As shown in FIG. 6, the door jamb reinforcing system 100 is installed in a door frame 605, which includes an opening 620 for receiving a lockset latch bolt (not shown) and an opening 625 for receiving a deadbolt latch bolt (not shown). The door frame 605 is usually nailed to a wall of a building. The wall includes framing studs 614 and gypsum board or other wall material 616 which is normally nailed thereto and a decorative overlay in the form of molding or trim 618. As it pertains to the installation of the door jamb reinforcing system 100, the door jamb may be viewed as including an inner latch bolt receiving face 610 and a perpendicular outer face 612 that is normally covered by molding 618.

As discussed above, the door jamb reinforcing system 100 of the present invention includes a first reinforcing member 110, a second reinforcing member 210, and a strike plate 310. As illustrated in FIG. 6, the first reinforcing member 110 and the second reinforcing member 210 are adapted to be mounted flush with an inner bolt receiving face of the door jamb. It should also be noted that some installations may not need or require the use of the first reinforcing member 110. In these cases, the second reinforcing member 210 can be used alone.

In various, non-limiting embodiments, the substantially L-shaped cross sectional profile of the second reinforcing member 210 allows the second reinforcing member 210 to lie in contacting abutting relation with the outer face 612 of the door jamb. In various, non-limiting embodiments, the substantially L-shaped cross sectional profile of the second reinforcing member 210 allows the second reinforcing member 210 to be slidably inserted beneath the decorative molding 618 of the door jamb.

During installation of the door jamb reinforcing system 100, the strike plate of the original door (not shown) is removed from the door frame 605. Next, the door jamb reinforcing system 100 is fitted to the door jamb and secured to the door jamb by inserting mounting screws 650 into each of the aligned second screw receiving openings 215 and first screw receiving opening 115 and screwing the mounting screws 650 into the adjacent framing studs 614. The strike plate 310 is then re-installed to fit within the strike plate receiving aperture 220.

Once installed, a lockset latch bolt may be received within the latch bolt receiving aperture 315 of the strike plate 310, the strike plate receiving aperture 220 of the second reinforcing member 210, and the lockset latch bolt receiving aperture 120 of the first reinforcing member 110.

Likewise, a deadbolt latch bolt may be received within a deadbolt latch bolt receiving aperture 225 of the second reinforcing member 210 and a deadbolt latch bolt receiving aperture 125 of the first reinforcing surface 312 of the strike plate. The tab reinforcement strip can be spot welded to slightly overlap the opening in the lip portion 212 to provide additional strength and rigidity to the overall door jamb reinforcement system 100.

The second reinforcing member 210 of this embodiment also includes screw receiving openings 215 that can be countersunk to allow for a flush mount installation. Deadbolt latch bolt receiving aperture plugs 230 are also shown. These deadbolt latch bolt receiving aperture plugs 230 are held in place within deadbolt latch bolt receiving apertures 225 by connectors 235 that are relatively easily broken. The deadbolt latch bolt receiving aperture plugs 230 can be popped out to expose the desired deadbolt latch bolt receiving apertures 225 that correspond to actual deadbolt latch bolts in a door. The deadbolt latch bolt receiving aperture plugs 230 that are not popped out can have the excess space filled with caulk, putty or the like to create a continuous smooth eye pleasing appearance.

Figure 7A:
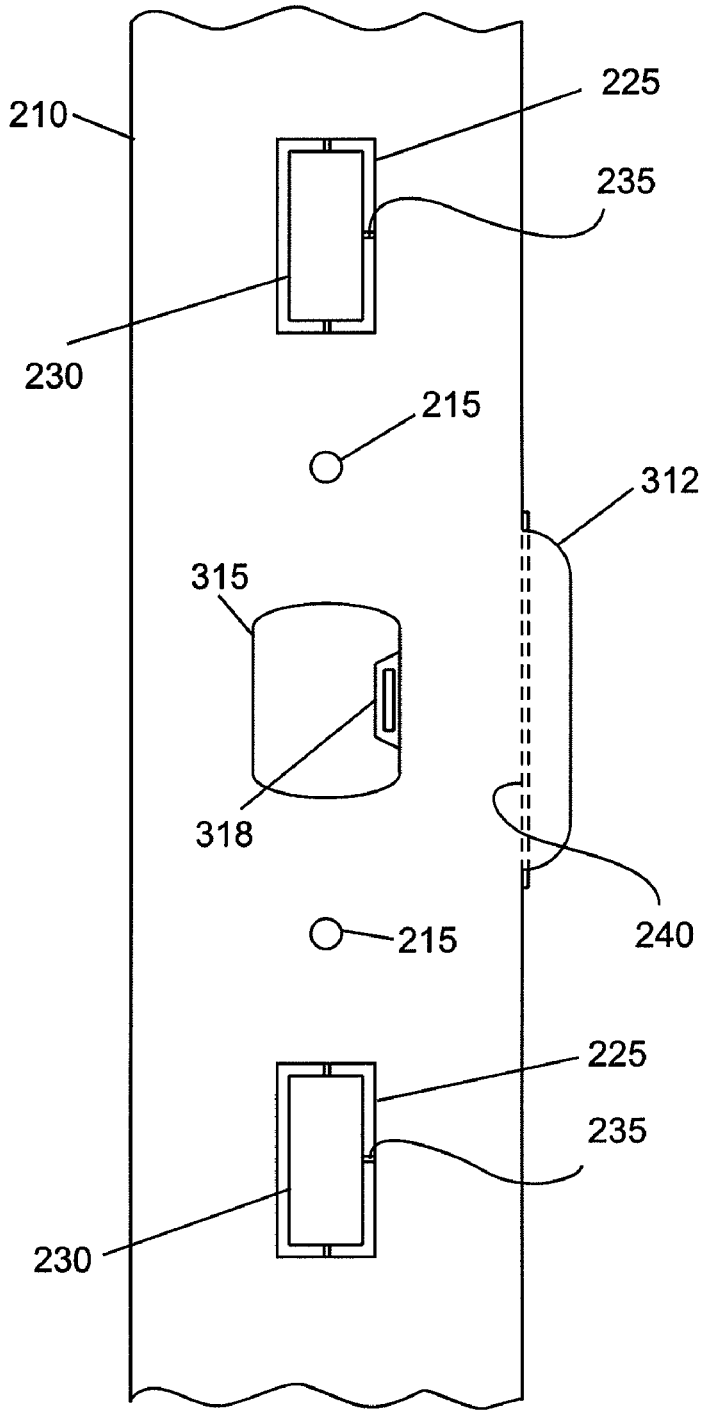
FIGS. 7A and 7B show a more detailed front and side view of a another embodiment of a second reinforcing member for a door jamb reinforcing system according to the invention, wherein a strike plate has been integrated into the second reinforcing member.
Figure 7B:
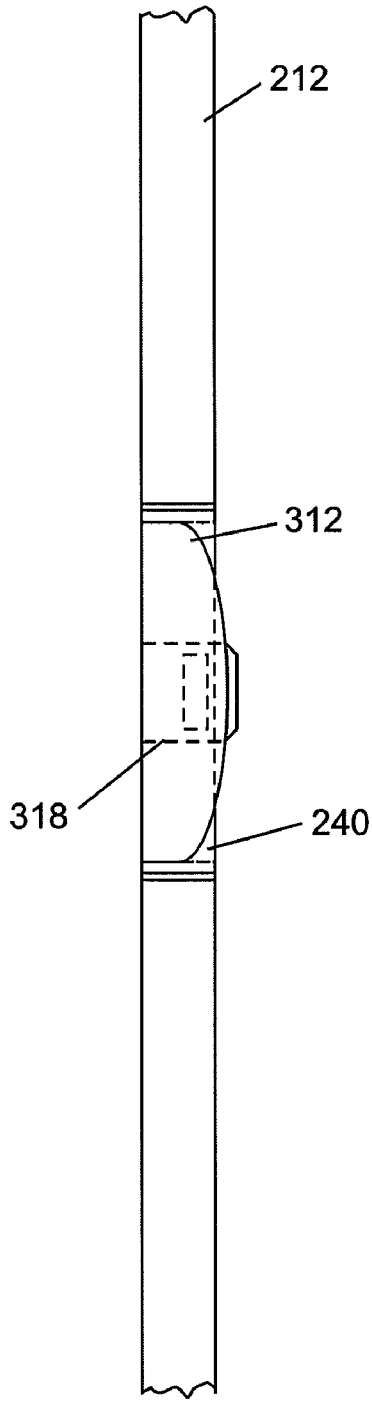
Figure 8:
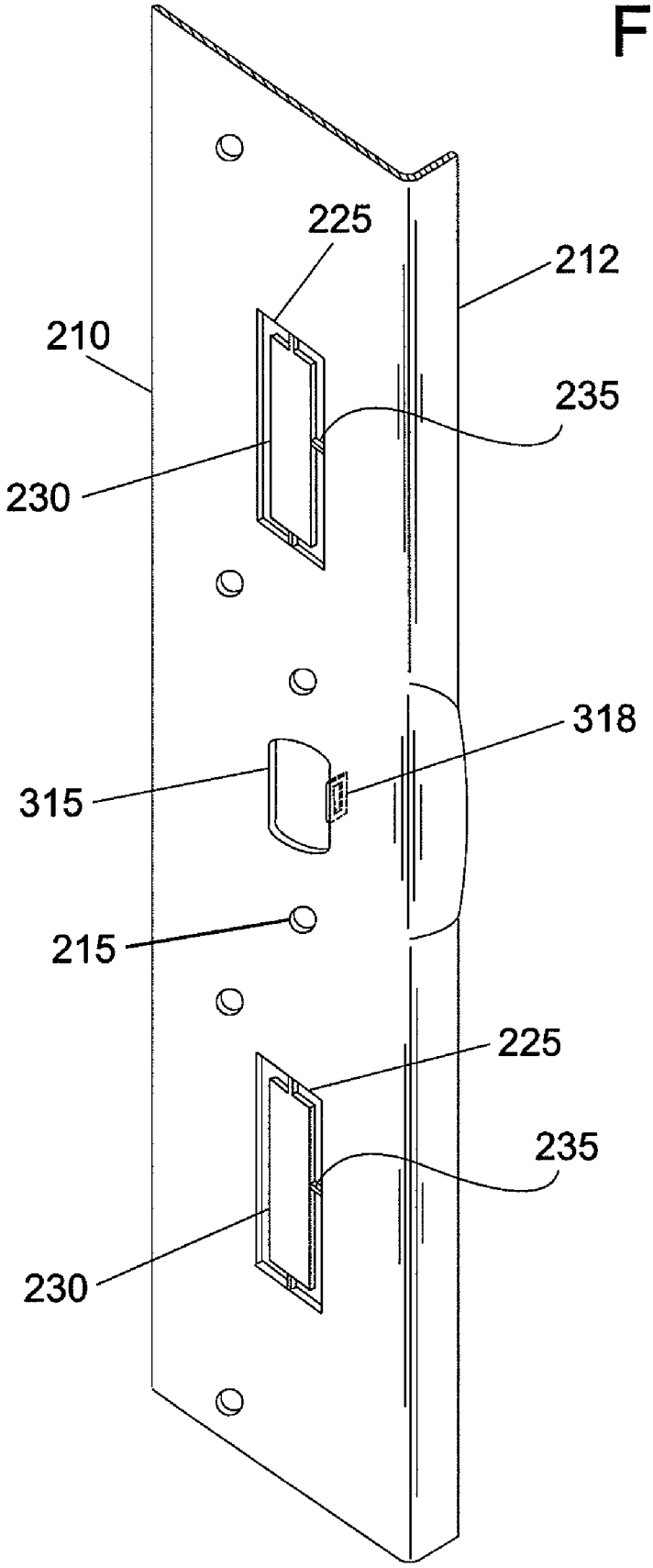
FIG. 8 shows a perspective view of the second reinforcing member for a door jamb reinforcing system according to the invention, wherein a strike plate has been integrated into the second reinforcing member.

FIG. 8 shows a perspective view of the second reinforcing member 210 for a door jamb reinforcing system 100 according to the invention, wherein a strike plate has been integrated into the second reinforcing member 210. The elements shown in FIGS. 7A and 7B are also shown here and need not be repeated.

Figure 9:
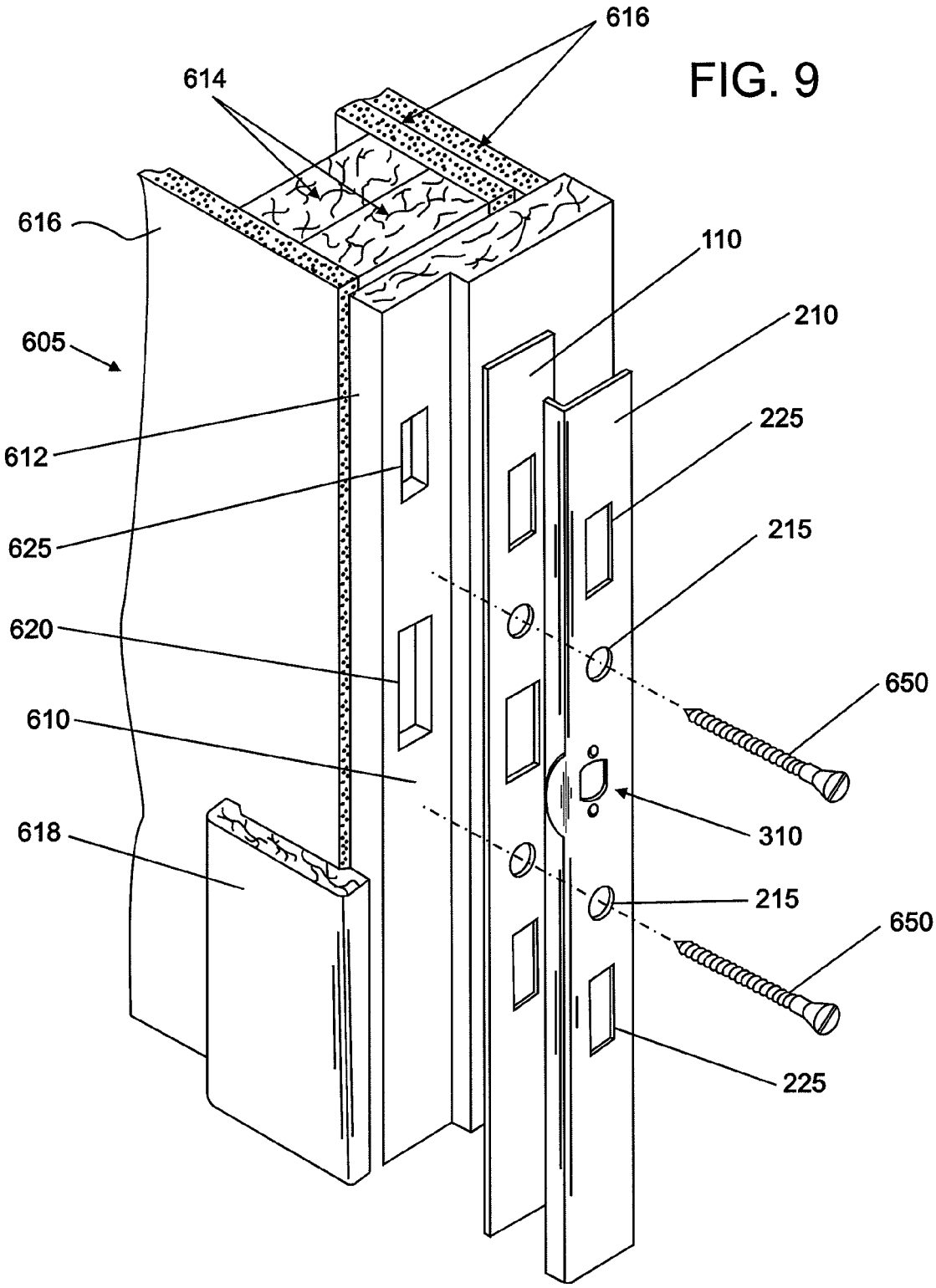
FIG. 9 shows a view of another embodiment of a door jamb reinforcing system, wherein the door jamb reinforcing system is being installed on a door jamb according to the invention.

FIG. 9 shows a view of an embodiment of a door jamb reinforcing system, wherein the door jamb reinforcing system is being installed on a typical door jamb. As shown in FIG. 9, the door jamb reinforcing system is member 110. Thus, the door jamb is strengthened as the door jamb reinforcing system 100 is structurally interconnected with the wall and as a result, the amount of force required to obtain forced entry through the door is substantially increased and forced entry is, therefore, more difficult.

In another embodiment, the strike plate is integrated directly into and becomes a part of the second reinforcing member.

FIGS. 7A and 7B show a more detailed front and side view of a another embodiment of a second reinforcing member 210 for a door jamb reinforcing system 100 according to the invention, wherein a strike plate has been integrated into the second reinforcing member 210.

In this embodiment, the strike plate has been integrated into the second reinforcing member 210 and includes at least some of a ramped surface 312 and a cut out area defining a latch bolt receiving aperture 315. A latch bolt adjustment tab 318 is also included. The latch bolt adjustment tab 318 can be bent or otherwise manipulated to adjust the effective size of the latch bolt receiving aperture 315 to more snugly accept a latch bolt. This is typically done following installation and is intended to reduce or eliminate any door wiggle that may result from a latch bolt that is not entirely snug within the latch bolt receiving aperture 315 of the strike plate 310.

The second reinforcing member 210 optionally includes a tab reinforcement strip 240 that covers an open area on the lip portion 212 of the second reinforcing member 210 that is directly beneath the ramped installed in a door frame 605, which includes an opening 620 for receiving a lockset latch bolt (not shown) and an opening 625 for receiving a deadbolt latch bolt (not shown). The door frame 605 is usually nailed to a wall of a building. The wall includes framing studs 614 and gypsum board or other wall material 616 which is normally nailed thereto and a decorative overlay in the form of molding or trim 618. As it pertains to the installation of the door jamb reinforcing system, the door jamb may be viewed as including an inner latch bolt receiving face 610 and a perpendicular outer face 612 that is substantially covered by molding 618.

As previously discussed, the door jamb reinforcing system includes a first reinforcing member 110 and a second reinforcing member 210 wherein the second reinforcing member 210 includes an integrated strike plate 310. The first reinforcing member 110 and the second reinforcing member 210 are adapted to be mounted flush with the inner bolt receiving face 610 of the door jamb. It should also be noted that some installations may not need or require the use of the first reinforcing member 110. In these cases, the second reinforcing member 210 can be used alone.

In various, non-limiting embodiments, the substantially L-shaped cross sectional profile of the second reinforcing member 210 allows the second reinforcing member 210 to lie in contacting abutting relation with the outer face 612 of the door jamb. In various, non-limiting embodiments, the substantially L-shaped cross sectional profile of the second reinforcing member 210 allows the second reinforcing member 210 to be slidably inserted beneath the decorative molding 618 of the door jamb.

During installation of the door jamb reinforcing system, the original strike plate for the door jamb (not shown) is removed from the door frame 605. Next, the door jamb reinforcing system is fitted to the door jamb and secured to the door jamb by inserting mounting screws 650 into each of the aligned second screw receiving openings 215 and first screw receiving openings 115 and screwing the mounting screws 650 into the adjacent framing studs 614.

Once installed, a lockset latch bolt may be received within the latch bolt receiving aperture 315 of the integrated strike plate 310 of the second reinforcing member 210, and the lockset latch bolt receiving aperture 120 of the first reinforcing member 110 (if used).

Likewise, a deadbolt latch bolt may be received within a deadbolt latch bolt receiving aperture 225 of the second reinforcing member 210 and a deadbolt latch bolt receiving aperture 125 of the first reinforcing member 110 (if used). Thus, the door jamb is strengthened as the door jamb reinforcing system is structurally interconnected with the wall and as a result, the amount of force required to obtain forced entry through the door is substantially increased and forced entry is, therefore, more difficult.

It should be noted that the door jamb reinforcing system 100 is described with respect to first 110 and second 210 reinforcing members. Use of both members 110, 210 adds even greater strength than using only a single reinforcing member 210. However, use of a single reinforcing member 210 is optional and sometimes preferable depending on the existing dimensions of a door frame. Virtually all the benefits obtained from using both reinforcing members 110, 210 can be obtained from using just a single reinforcing member 210.

While this invention has been described in conjunction with the exemplary embodiments outlined above, it is evident that many alternatives, modifications, and variations will be apparent to those skilled in the art. For example, in various exemplary embodiments of the door jamb reinforcing system, the strike plate may not be included as a separate element, but useful features of the strike plate may be incorporated into either the first reinforcing member 110 or the second reinforcing member 210. Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A door jamb reinforcing system for reinforcing a door jamb comprising:

a substantially rigid reinforcing member having an inner plate and a perpendicular outer plate creating an L-shaped cross-section, including:

a plurality of spaced apart holes defining screw receiving openings for receiving mounting screws;

an integrated strike plate provided on the inner plate and including a cut out area defining a latch bolt receiving aperture adapted to receive a latchbolt and a ramped surface adapted to guide the latchbolt into the latchbolt receiving aperture, a reinforcement strip provided to cover an open area beneath the ramp and attached to the outer plate providing strength to the reinforcing member, the reinforcing member having a length sufficient to extend above and below the ramped surface a multiple greater than one of the extent of the ramped surface;

a latch bolt adjustment tab having a cut out slit such that a tool can be inserted into the slit to adjust the position of the latch bolt adjustment tab relative to the latch bolt receiving aperture to ensure a snug fit with a latch bolt; and at least one cut out area defining a deadbolt latch bolt receiving aperture adapted to receive respective deadbolt, the deadbolt latchbolt receiving aperture being initially blocked by an aperture plug that substantially fills the aperture and is held in place by breakable connectors, so that when the connectors are broken, it will expose the aperture to be used.

2. The door jamb reinforcing system of claim 1 wherein the reinforcing member is metal.

3. The door jamb reinforcing system of claim 1 wherein the latch bolt receiving aperture is generally formed centrally to the reinforcing member.

4. The door jamb reinforcing system of claim 1 wherein the plurality of spaced apart holes defining screw receiving openings are countersunk.

5. A door jamb reinforcing system for reinforcing a door jamb comprising:

a substantially rigid reinforcing member having an inner plate and a perpendicular outer plate creating an L-shaped cross-section, including:

a plurality of spaced apart holes defining screw receiving openings for receiving mounting screws;

an integrated strike plate provided in the inner plate and including a cut out area defining a latch bolt receiving aperture adapted to receive a latch bolt and a ramped surface adapted to guide a latchbolt into the latchbolt receiving aperture, a reinforcement strip provided to cover an open area in the outer plate beneath the ramp and attached to the outer plate providing strength to the reinforcing member the reinforcing member having a length sufficient to extend above and below the ramped surface a multiple greater than one of the extent of the ramp surface.

* * * * *

UNITED STATES PATENT AND TRADEMARK OFFICE

CERTIFICATE OF CORRECTION

PATENT NO. : 8,132,832 B2
APPLICATION NO. : 12/126085
DATED : March 13, 2012
INVENTOR(S) : Edward R. Anderson It is certified that error appears in the above-identified patent and that said Letters Patent is hereby corrected as shown below:

In Column 10, Line 26, there should be a (,) between the words member and the

Signed and Sealed this
Eighth Day of May, 2012

David J. Kappos

David J. Kappos
*Director of the United States Patent and Trademark Office*